US010049618B2

(12) United States Patent
Jeong

(10) Patent No.: US 10,049,618 B2
(45) Date of Patent: Aug. 14, 2018

(54) ORGANIC LIGHT EMITTING DISPLAY DEVICE CHANGING POWER VOLTAGE BASED ON MEASURED OUTPUT CURRENT AND METHOD OF DRIVING THE SAME

(71) Applicant: Samsung Display Co., LTD., Yongin-si, Gyeonggi-Do (KR)

(72) Inventor: Il-Hun Jeong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 207 days.

(21) Appl. No.: 14/886,503

(22) Filed: Oct. 19, 2015

(65) Prior Publication Data

US 2016/0293107 A1 Oct. 6, 2016

(30) Foreign Application Priority Data

Apr. 6, 2015 (KR) ..... 10-2015-0048358

(51) Int. Cl.
*G09G 3/3233* (2016.01)
*G09G 3/20* (2006.01)
*G09G 3/3225* (2016.01)

(52) U.S. Cl.
CPC ..... *G09G 3/3233* (2013.01); *G09G 3/2014* (2013.01); *G09G 3/3225* (2013.01); *G09G 2300/0842* (2013.01); *G09G 2320/0295* (2013.01); *G09G 2320/043* (2013.01); *G09G 2320/045* (2013.01); *G09G 2330/028* (2013.01); *G09G 2360/16* (2013.01)

(58) Field of Classification Search
CPC .. G09G 3/3233; G09G 3/3258; G09G 3/3275; G09G 3/3208; G09G 3/3225; G09G 3/22; G09G 3/14; G09G 3/32; G09G 3/2014; G09G 3/2018; G09G 3/2022; G09G 3/2025; G09G 3/2029; G09G 3/2033; G09G 3/2037; G09G 2330/028
See application file for complete search history.

(56) References Cited

U.S. PATENT DOCUMENTS

| | | | | |
|---|---|---|---|---|
| 9,392,653 | B2 * | 7/2016 | Lee | H05B 33/0815 |
| 9,741,283 | B2 * | 8/2017 | Lee | G09G 3/2092 |
| 2005/0116657 | A1 * | 6/2005 | Park | G09G 3/22 315/169.3 |
| 2008/0024526 | A1 * | 1/2008 | Ko | G09G 3/3233 345/690 |
| 2008/0158218 | A1 * | 7/2008 | Kim | G09G 3/3225 345/212 |

(Continued)

FOREIGN PATENT DOCUMENTS

| | | | |
|---|---|---|---|
| JP | 2008256827 | A | 10/2008 |
| KR | 1020020066209 | A | 8/2002 |

(Continued)

*Primary Examiner* — Darlene M Ritchie
(74) *Attorney, Agent, or Firm* — Cantor Colburn LLP

(57) ABSTRACT

A method of driving an organic light emitting display device includes performing a digital driving on a display panel supplied with a first power voltage through a first power supply line, generating a target voltage signal of the first power voltage by analyzing input image data provided to the display panel, measuring an output current that flows through the first power supply line, and changing the first power voltage based on a measured output current and the target voltage signal.

11 Claims, 10 Drawing Sheets

(56) References Cited

U.S. PATENT DOCUMENTS

| | | | | |
|---|---|---|---|---|
| 2009/0027375 | A1* | 1/2009 | Ryu | G09G 3/3208 345/212 |
| 2009/0201281 | A1* | 8/2009 | Routley | G09G 3/3233 345/212 |
| 2010/0171774 | A1* | 7/2010 | Mizukoshi | G09G 3/3275 345/690 |
| 2012/0236041 | A1* | 9/2012 | Oh | G09G 3/3258 345/690 |
| 2013/0003230 | A1* | 1/2013 | Kojima | H05B 33/089 361/18 |
| 2013/0021228 | A1* | 1/2013 | Miwa | G09G 3/3233 345/76 |
| 2014/0009512 | A1* | 1/2014 | Lee | G09G 5/02 345/690 |
| 2015/0243218 | A1* | 8/2015 | Tseng | G09G 3/3258 345/212 |
| 2015/0356899 | A1* | 12/2015 | Yamanaka | G09G 3/14 345/690 |
| 2016/0078842 | A1* | 3/2016 | Farenc | G09G 5/006 345/212 |

FOREIGN PATENT DOCUMENTS

| | | | |
|---|---|---|---|
| KR | 1020050123325 | A | 12/2005 |
| KR | 1020070072057 | A | 7/2007 |
| KR | 1020080057434 | A | 6/2008 |
| KR | 1020090011752 | A | 2/2009 |
| KR | 1020100003591 | A | 1/2010 |
| KR | 1020130102256 | A | 9/2013 |
| KR | 1020140078419 | A | 6/2014 |

* cited by examiner

ORGANIC LIGHT EMITTING DISPLAY DEVICE CHANGING POWER VOLTAGE BASED ON MEASURED OUTPUT CURRENT AND METHOD OF DRIVING THE SAME

This application claims priority to Korean Patent Application No. 10-2015-0048358, filed on Apr. 6, 2015, and all the benefits accruing there from under 35 U.S.C. § 119, the content of which in its entirety is incorporated herein by reference.

BACKGROUND

1. Field

Exemplary embodiments relate to a display device. More particularly, exemplary embodiments of the invention relate to an organic light emitting display device and a method of driving the organic light emitting display device.

2. Description of the Related Art

Generally, an organic light emitting display device displays an image using an organic light emitting diode that emits light based on recombination of electrons and holes.

SUMMARY

As an organic light emitting diode is deteriorated (or, degraded), a current-voltage characteristic of the organic light emitting display device may be changed, and a current efficiency of the organic light emitting display device may be changed. Particularly, in case of the organic light emitting display device that employs a digital driving technique in which a constant voltage driving is performed, as a data voltage set higher considering a degradation, the current efficiency may be lowered. In addition, a current flowing through the organic light emitting diode may be changed according to an ambient temperature of the organic light emitting display device, and thus luminance of the organic light emitting display device may be changed.

Exemplary embodiments provide a method of driving an organic light emitting display device capable of compensating a luminance change due to degradation of an organic light emitting diode or a change in an operating condition (e.g., an ambient temperature, etc.) of the organic light emitting display device.

Exemplary embodiments provide an organic light emitting display device capable of quickly compensating a luminance change using a simple circuit configuration.

According to exemplary embodiments, a method of driving an organic light emitting display device may include performing a digital driving on a display panel supplied with a first power voltage through a first power supply line, generating a target voltage signal of the first power voltage by analyzing input image data provided to the display panel, measuring an output current that flows through the first power supply line, and changing the first power voltage based on a measured output current and the target voltage signal.

In exemplary embodiments, generating the target voltage signal may include generating target current data based on grayscales of the input image data, calculating target voltage data based on the target current data, and converting the target voltage data into the target voltage signal in an analog form.

In exemplary embodiments, the target voltage data may be calculated using a current-voltage characteristic of the display panel.

In exemplary embodiments, the target voltage data may be generated using a first-order linear equation between the target current data and the target voltage data.

In exemplary embodiments, changing the first power voltage may include generating a measured current signal by measuring the output current, and compensating the target voltage signal based on the measured current signal.

In exemplary embodiments, the measured current signal may be generated by amplifying a voltage difference between different points in the first power supply line.

In exemplary embodiments, compensating the target voltage signal may include generating a difference voltage signal by differentially amplifying the measured current signal and the target voltage signal, and increasing or decreasing the target voltage signal by the difference voltage signal.

In exemplary embodiments, changing the first power voltage may include generating the first power voltage based on a compensated target voltage signal.

According to exemplary embodiments, a method of driving an organic light emitting display device may include performing a digital driving on a display panel supplied with a first power voltage through a first power supply line, generating a target voltage signal of the first power voltage by analyzing input image data provided to the display panel, and changing an output current flowing through the first power supply line based on the target voltage signal and a voltage at a point of the first power supply line.

In exemplary embodiments, generating a target voltage signal may include generating target current data based on grayscales of the input image data, calculating target voltage data based on the target current data, and converting the target voltage data into the target voltage signal in an analog form.

In exemplary embodiments, the target voltage data may be calculated using a current-voltage characteristic of the display panel.

In exemplary embodiments, the target voltage data may be generated using a first-order linear equation between the target current data and the target voltage data.

In exemplary embodiments, changing the output current may include generating a measured voltage signal by measuring voltages at the some points, compensating the target voltage signal based on the measured voltage signal; and controlling a current flowing through the first power supply line based on a compensated target voltage signal.

In exemplary embodiments, compensating the target voltage signal may include amplifying the measured voltage signal and the target voltage signal differentially.

In exemplary embodiments, controlling the current may include supplying the compensated target voltage signal to a switching component that is electrically connected in series to the first power supply line.

According to exemplary embodiments, an organic light emitting display device may include a display panel configured to receive a first power voltage through a first power supply line and configured to operate (or, display an image) based on a digital driving technique, a power controller configured to generate a target voltage signal of the first power voltage by analyzing input image data provided to the display panel, and a power supplier configured to measure an output current that flows through the first power voltage line and configured to change the first power voltage based on a measured output current and the target voltage signal.

In exemplary embodiments, the power controller may include a calculator configured to generate target current data based on grayscales of the input image data and to calculate target voltage data based on the target current data, and a digital-analog converter configured to output the target voltage signal by converting the target voltage data into the target voltage signal in an analog form.

In exemplary embodiments, the power supplier may include a current measuring unit configured to generate a measured current signal by measuring the output current, and a power circuit unit configured to compensate the target voltage signal based on the measured current signal and configured to generate the first power voltage based on a compensated target voltage signal.

In exemplary embodiments, the current measuring unit may include a measuring resistive element electrically connected in series to the first power supply line, and an amplifier configured to output the measured current signal by amplifying voltages at ends of the measuring resistive element differentially.

In exemplary embodiments, the power circuit unit may be configured to generate a difference voltage signal by differentially amplifying the measured current signal and the target voltage signal and configured to increase or decrease the target voltage signal by the difference voltage signal.

Therefore, a method of driving an organic light emitting display device according to exemplary embodiments may compensate a luminance change due to degradation of an organic light emitting diode or a change in an operating condition (e.g., an ambient temperature, etc) of the organic light emitting display device by controlling an output current supplied to a display panel to be equal to a target current to be supplied to the display panel based on a first-order linear control equation.

In addition, an organic light emitting display device according to exemplary embodiments may quickly compensate a luminance change using a simple circuit configuration that directly compensates target voltage data corresponding to a target current based on a measured current.

BRIEF DESCRIPTION OF THE DRAWINGS

Illustrative, non-limiting exemplary embodiments, advantages and features of this disclosure will be more clearly understood from the following detailed description taken in conjunction with the accompanying drawings, in which.

DETAILED DESCRIPTION

Figure 1:
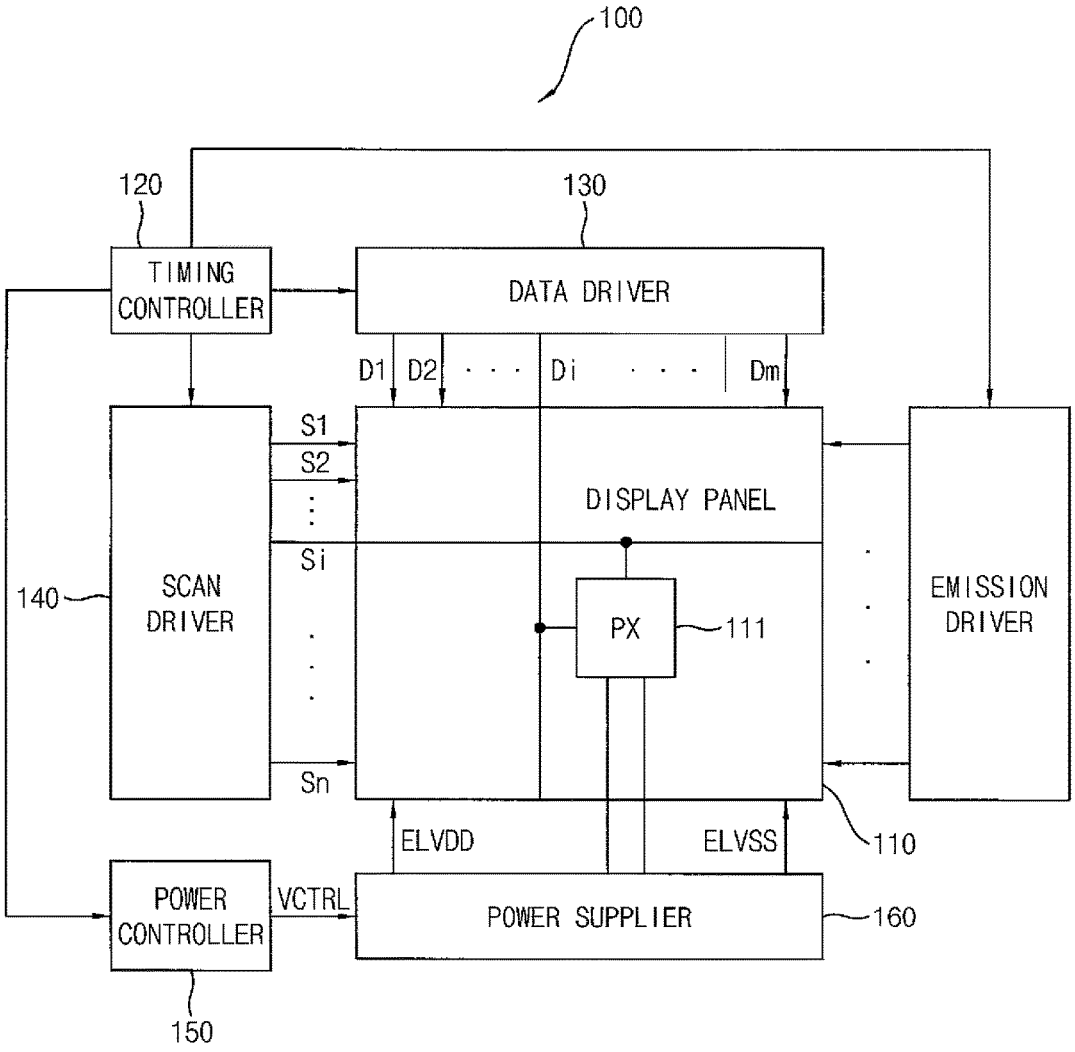
FIG. 1 is a block diagram illustrating an organic light emitting display device according to exemplary embodiments.

Hereinafter, the invention will be explained in detail with reference to the accompanying drawings.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a block diagram illustrating an organic light emitting display device according to exemplary embodiments.

Referring to FIG. 1, the organic light emitting display device 100 may include a display panel 110, a timing controller 120, a data driver 130, a scan driver 140, a power controller 150, and a power supplier 160.

The display panel 110 may include pixels 111 disposed at intersections of scan lines S1 through Sn and data lines D1 through Dm, where n and m are integers greater than or equal to 2. The display panel 110 may operate (or, display an image) based on a digital driving technique. The digital driving technique is one of various techniques for driving the display panel 110. According to the digital driving technique, the pixels 111 may be supplied with a constant data voltage and grayscales may be represented by changing (or, adjusting) a light emission time in which an organic light emitting diode emits light.

Each of the pixels 111 may store a data signal supplied through the data lines D1 through Dm in response to a scan signal supplied through the scan lines S1 through Sn. Each of the pixels 111 may emit light with luminance corresponding to the stored data signal. A structure of the pixel 111 will be explained in detail with reference to FIG. 2.

The timing controller 120 may control operations of the data driver 130 and the scan driver 140 of the organic light emitting display device 100. The timing controller 120 may generate input image data and a data driving control signal to provide the data driver 130 with the input image data and the data driving control signal. The timing controller 120 may generate a scan control signal to provide the scan control signal to the scan driver 140. The timing controller 120 may provide the input image data to the power controller 150. The input image data provided to the power controller 150 may be used to control a first power voltage ELVDD.

The data driver 130 may generate a data signal based on the input image data. The data driver 130 may provide the data signal to the pixels 111 through the data lines D1 through Dm in response to the data control signal. The data driver 130 may generate the data signal from the input image data using a gamma filter, a digital-analog converter ("DAC"), etc.

The scan driver 140 may generate a scan signal based on the scan driving control signal. The scan driver 140 may provide the pixels 111 with the scan signal through the scan lines S1 through Sn. In an exemplary embodiment, the scan control signal may include a start pulse and a clock pulse, for example. In an exemplary embodiment, the scan driver 140 may include a shift register that sequentially generates the scan signal based on the start pulse and the clock pulse, for example. In an exemplary embodiment, the organic light emitting display device 100 may further include an emission driver, for example. In the exemplary embodiment, the emission driver may generate an emission control signal and may provide the pixels 111 with the emission control signal through emission control lines.

The power controller 150 may generate a power voltage control signal based on the input image data provided from the timing controller 120. The power voltage control signal may be a signal to control a magnitude of the first power voltage ELVDD generated by the power supplier 160.

In an exemplary embodiment, the power controller 150 may calculate an average grayscale (or, an average luminance), for example. The power controller 150 may generate target current data based on the average grayscale. The target current data may include a predetermined current value to limit a current supplied to the pixels 111 (i.e., data for an automatic current limit ("ACL")). The power controller 150 may convert the target current data to the power voltage control signal in an analog form. The power controller 150 may provide the power voltage control signal to the power supplier 160. A structure of the power controller 150 will be explained in detail with reference to FIGS. 3 to 10.

The power supplier 160 may generate the first power voltage ELVDD and a second power voltage ELVSS. The power supplier 160 may supply each of the pixels 111 with the first power voltage ELVDD through a first power supply line and may supply the second power voltage ELVSS through a second power supply line. The first power voltage ELVDD may have a voltage level higher than that of the second power voltage ELVSS. In an exemplary embodiment, the power supplier 160 may include a direct current to direct current ("DC-DC") converter, for example.

The power supplier 160 may change (or, adjust, control) the first power voltage ELVDD in response to the power voltage control signal provided from the power controller 150. The power supplier 160 may change the first power voltage ELVDD to control an output current to track the target current data (i.e., the power supplier 160 may change the first power voltage ELVDD to accurately output the output current corresponding to the target current data). In an exemplary embodiment, the power supplier 160 may measure (or, sense, detect) the output current supplied to the display panel 110 by using a feedback circuit. In addition, the power supplier 160 may change the first power voltage ELVDD based on a difference between a measured output current (i.e., a measured current signal) and the power voltage control signal (or, a target voltage signal). A structure of the power supplier 160 will be explained in detail with reference to FIG. 3.

Figure 2:
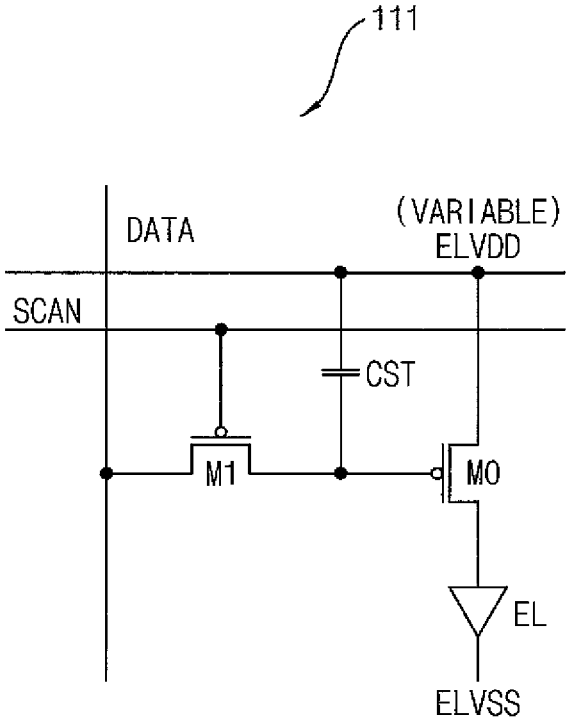
FIG. 2 is a circuit diagram illustrating an example of a pixel included in the organic light emitting display device of FIG. 1.

FIG. 2 is a circuit diagram illustrating an example of a pixel included in the organic light emitting display device of FIG. 1.

Referring to FIGS. 1 and 2, the pixel 111 may include a driving transistor (e.g., thin film transistor) M0, a switching transistor M1, a storage capacitor Cst, and an organic light emitting diode EL.

A gate electrode of the switching transistor M1 may be electrically connected to a scan line. A first electrode of the switching transistor M1 may be electrically connected to a data line, and a second electrode of the switching transistor M1 may be electrically connected to a gate electrode of the driving transistor M0. The switching transistor M1 may transfer a data signal DATA to the gate electrode of the driving transistor M0 in response to a scan signal SCAN supplied through the scan line.

The gate electrode of the driving transistor M0 may be electrically connected to the second electrode of the switching transistor M1. A first electrode of the driving transistor M0 may be electrically connected to the first power voltage ELVDD. A second electrode of the driving transistor M0 may be electrically connected to a cathode of the organic light emitting diode EL. The driving transistor M0 may control a current to flow or not to flow through the organic light emitting diode EL in response to the data signal DATA.

The storage capacitor Cst may be electrically connected between the first power voltage ELVDD and the gate electrode of the driving transistor M0. The storage capacitor Cst may temporarily store the data signal DATA transferred through the switching transistor M1.

The organic light emitting diode EL may be electrically connected between the second electrode of the driving transistor M0 and the second power voltage ELVSS. The organic light emitting diode EL may emit light corresponding to a current supplied through the driving transistor M0 in response to the data signal DATA.

A current flowing in the pixel 111 may be influenced by a driving condition of the organic light emitting display device 100 such as a temperature of the display panel 110, a current-resistor ("IR") drop characteristic, a current-voltage-luminance ("IVL") deviation of the organic light emitting diode EL, degradation, etc. In an exemplary embodiment, as the temperature of the display panel 110 is raised, the current flowing in pixel 111 may be increased. Thus, the organic light emitting diode EL may emit light having luminance different from target luminance (e.g., the luminance of the organic light emitting diode EL before the temperature of the display panel 110 is raised).

The organic light emitting display device 100 may control the current flowing in the pixel 111 by changing the first power voltage ELVDD such that the pixel 111 may emit light corresponding to the target luminance. In an exemplary embodiment, the organic light emitting display device 100 may measure the current that flows in the pixel 111, may detect a luminance change (or, luminance variation) of the pixel 111 due to a temperature change, and may control the first power voltage ELVDD corresponding to a change of a pixel characteristic. Therefore, even when the temperature is changed, the organic light emitting display device 100 may keep (or, maintain) an amount of the current to be constant. However, since the pixel 111 of FIG. 2 is an exemplary embodiment, the pixel 111 is not limited thereto.

Figure 3:
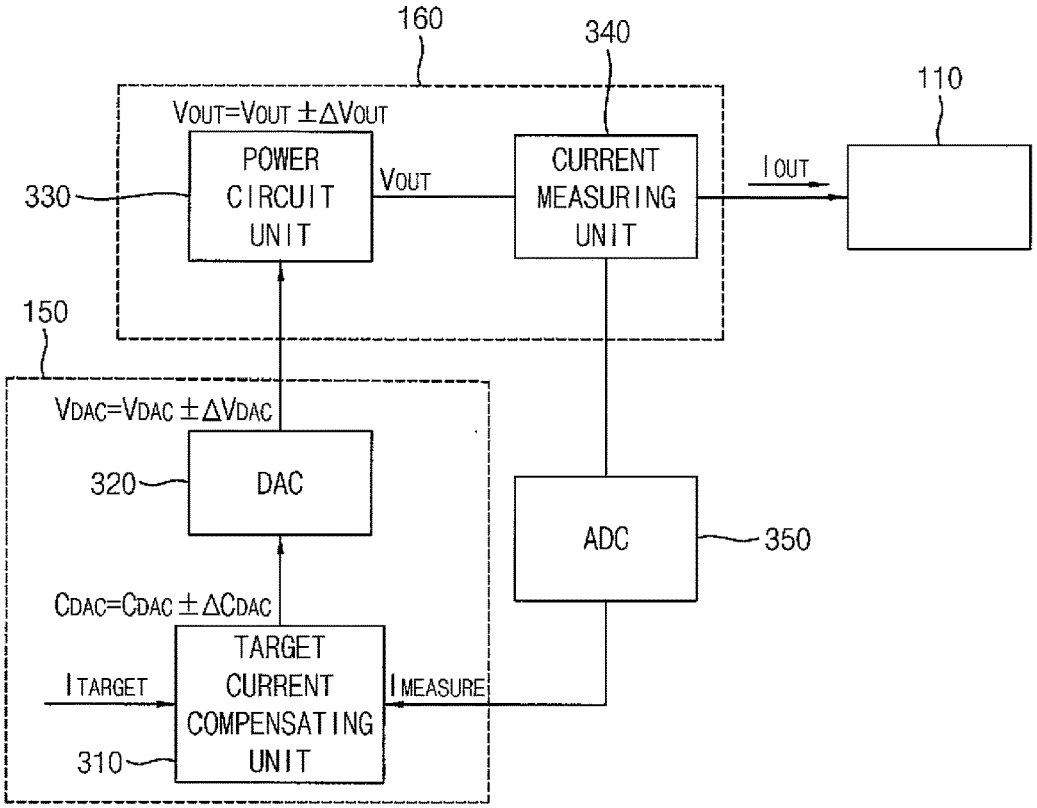
FIG. 3 is a block diagram illustrating an example of a power controller and a power supplier included in the organic light emitting display device of FIG. 1.

FIG. 3 is a block diagram illustrating an example of a power controller and a power supplier included in the organic light emitting display device of FIG. 1.

Referring to FIGS. 1 and 3, the power controller 150 may compensate target current data $I_{TARGET}$ based on a measured current signal $I_{MEASURE}$. The power controller 150 may generate target voltage data $C_{DAC}$ corresponding to compensated target current data $I_{TARGET}$. The power controller 150 may generate a power voltage control signal $V_{DAC}$ (or, a voltage control signal) by converting the target voltage data $C_{DAC}$ into a signal in an analog form. The power supplier 160 may generate the first power voltage ELVDD based on the power voltage control signal $V_{DAC}$ and may measure an output current $I_{OUT}$ that flows through a first power supply line. The organic light emitting display device 100 may include an analog-digital converter ("ADC") 350 that converts a measured output current into a signal (i.e., a digital signal) used in the power controller 150.

The power controller 150 may include a target current compensating unit 310 and a DAC320.

The target current compensating unit 310 may generate the target voltage data $C_{DAC}$ based on the target current data $I_{TARGET}$ and the measured current signal $I_{MEASURE}$. FIG. 3 is illustrated that the target current compensating unit 310 receives the target current data $I_{TARGET}$. However, the target current compensating unit 310 is not limited thereto. In an exemplary embodiment, the target current compensating unit 310 may be a micro-processor, e.g., micro controller unit ("MCU"), and the target current compensating unit 310 may generate the target current data $I_{TARGET}$ by analyzing grayscales of input image data.

In an exemplary embodiment, the target current compensating unit 310 may output the target voltage data $C_{DAC}$ that is generated by using a look-up table ("LUT") that includes the compensated target current data corresponding to the target current data $I_{TARGET}$ and the measured current signal $I_{MEASURE}$. In an exemplary embodiment, the target current compensating unit 310 may include algorithms for calculating the target voltage data $C_{DAC}$ based on the target current data $I_{TARGET}$ and the measured current signal $I_{MEASURE}$.

The DAC320 may output the target voltage signal $V_{DAC}$ by converting the target current data $C_{DAC}$ into an analog signal.

The power supplier 160 may include the power circuit unit 330 and a current measuring unit 340.

The power circuit unit 330 may generate the first power voltage ELVDD based on the target voltage signal $V_{DAC}$ (e.g., a power voltage control signal). In an exemplary embodiment, the power circuit unit 330 may select the first power voltage ELVDD among a plurality of the first power voltages in response to the target voltage signal $V_{DAC}$. In an exemplary embodiment, the power circuit unit 330 may be a DC-DC converter, for example.

The current measuring unit 340 may output a measured current signal by measuring the output current $I_{OUT}$. The current measuring unit 340 may include a resistor electrically connected between the power circuit unit 330 and the display panel 110. The current measuring unit 340 may output a voltage across the resistor as the measured current signal $I_{MEASURE}$.

The ADC 350 may convert the measured current signal into a digital signal that can be used in the target current compensating unit 310.

As described above, the organic light emitting display device 100 may compensate the target current data by using the measured current signal $I_{MEASURE}$. The organic light emitting display device 100 may adjust the first power voltage ELVDD based on compensated target current data (i.e., the target voltage data $C_{DAC}$ or the target voltage signal $V_{DAC}$).

A difference between the target current data $I_{TARGET}$ and the measured current $I_{MEASURE}$ may be represented as a first variation $\Delta C_{DAC}$ of the target voltage data $C_{DAC}$, a second variation $\Delta V_{DAC}$ of the target voltage signal $V_{DAC}$, and a third variation $\Delta V_{OUT}$ of the first power voltage ELVDD in each of units.

Figure 4A:
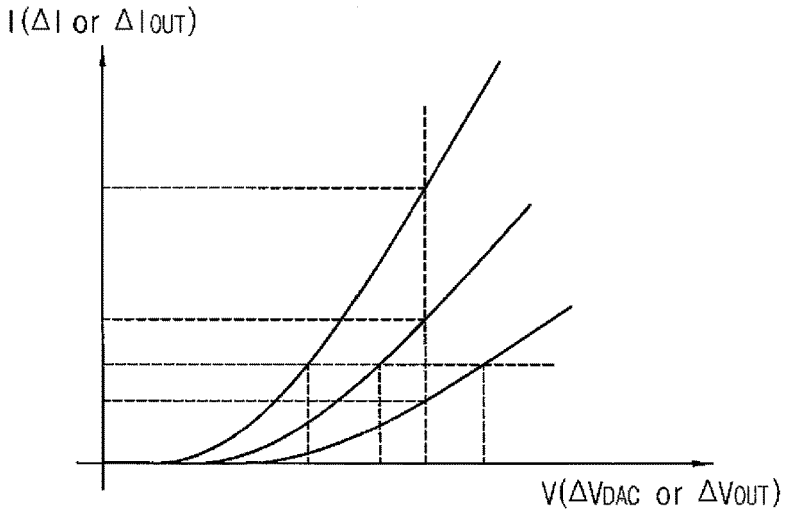
FIGS. 4A and 4B are waveform diagrams for describing an output current generated by the power controller and the power supplier of FIG. 3.
Figure 4B:
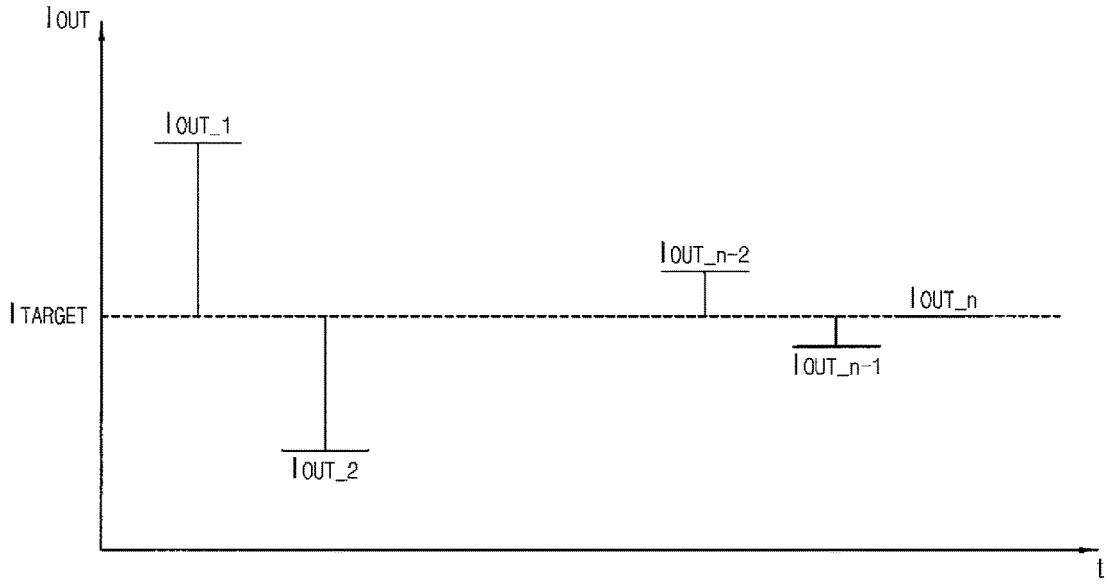

FIGS. 4A and 4B are waveform diagrams for describing an output current generated by the power controller and the power supplier of FIG. 3.

Referring to FIG. 4A, an X-axis represents the variation $\Delta V_{OUT}$ of the first power voltage ELVDD and a Y-axis represents the variation $\Delta I_{OUT}$ of the output current $I_{OUT}$.

As the variation $\Delta V_{OUT}$ of the first power voltage ELVDD is increased, the variation $\Delta I_{OUT}$ of the output current $I_{OUT}$ outputting from the power supplier 160 may be increased. The variation $\Delta V_{OUT}$ of the first power voltage ELVDD and the variation $\Delta I_{OUT}$ of the output current $I_{OUT}$ may have a non-linear relationship.

Because a current-voltage (I-V) characteristic of the organic light emitting diode is changed depending on a deposition dispersion of the display panel 110 and a driving condition (e.g., temperature, degradation, etc.) of the display panel 110, it is difficult to predict the variation $\Delta I_{OUT}$ of the output current $I_{OUT}$. Therefore, the organic light emitting display device 100 may control the output current $I_{OUT}$ to be equal to the target current data $I_{TARGET}$ by repeating a process of adjusting the output current $I_{OUT}$ during a relatively long time.

Referring to FIG. 4B, a change of the output current $I_{OUT}$ with time is illustrated. The organic light emitting display device 100 may output the first power voltage ELVDD based on the target current data $I_{TARGET}$. Here, the output current $I_{OUT}$ may be represented by a first output current $I_{OUT_1}$ which is greater than the target current data $I_{TARGET}$.

Next, the organic light emitting display device 100 may adjust the first power voltage ELVDD based on the target current data $I_{TARGET}$ and the first output current $I_{OUT_1}$. Here, the output current $I_{OUT}$ may have a current difference (i.e., the target current data $I_{TARGET}$−the measured current signal $I_{MEASURE}$) lower than the first output current $I_{OUT_1}$, but the output current $I_{OUT}$ may be represented by a second output current $I_{OUT_2}$ lower than the target current data $I_{TARGET}$.

Then, the organic light emitting display device 100 may repeatedly adjust the first power voltage ELVDD based on the target current data $I_{TARGET}$ and each of the output currents $I_{OUT_n\text{-}2}$ and $I_{OUT_n\text{-}1}$ (or, measured current signals). At n times, where n is an integer, the organic light emitting display device 100 may generate the first power voltage to output a n-th output current $I_{OUT_n}$ that has the same amount as that of the target current data $I_{TARGET}$.

As described above, after the organic light emitting display device 100 measures the output current $I_{OUT}$ and adjusts the first power voltage ELVDD repeatedly, the organic light emitting display device 100 may supply the display panel 110 with the output current $I_{OUT}$ that has the same amount as that of the target current data $I_{TARGET}$. However, it is difficult to predict the variation $\Delta I_{OUT}$ of the output current $I_{OUT}$ due to a variation $\Delta V_{OUT}$ of the first power voltage ELVDD. Therefore, the organic light emitting display device 100 may repeat a process of adjusting the output current $I_{OUT}$ during a relatively long time. In a process of adjusting the first power voltage ELVDD, a rocking of screen may occur due to a variation of luminance or a chromaticity coordinate.

Figure 5:
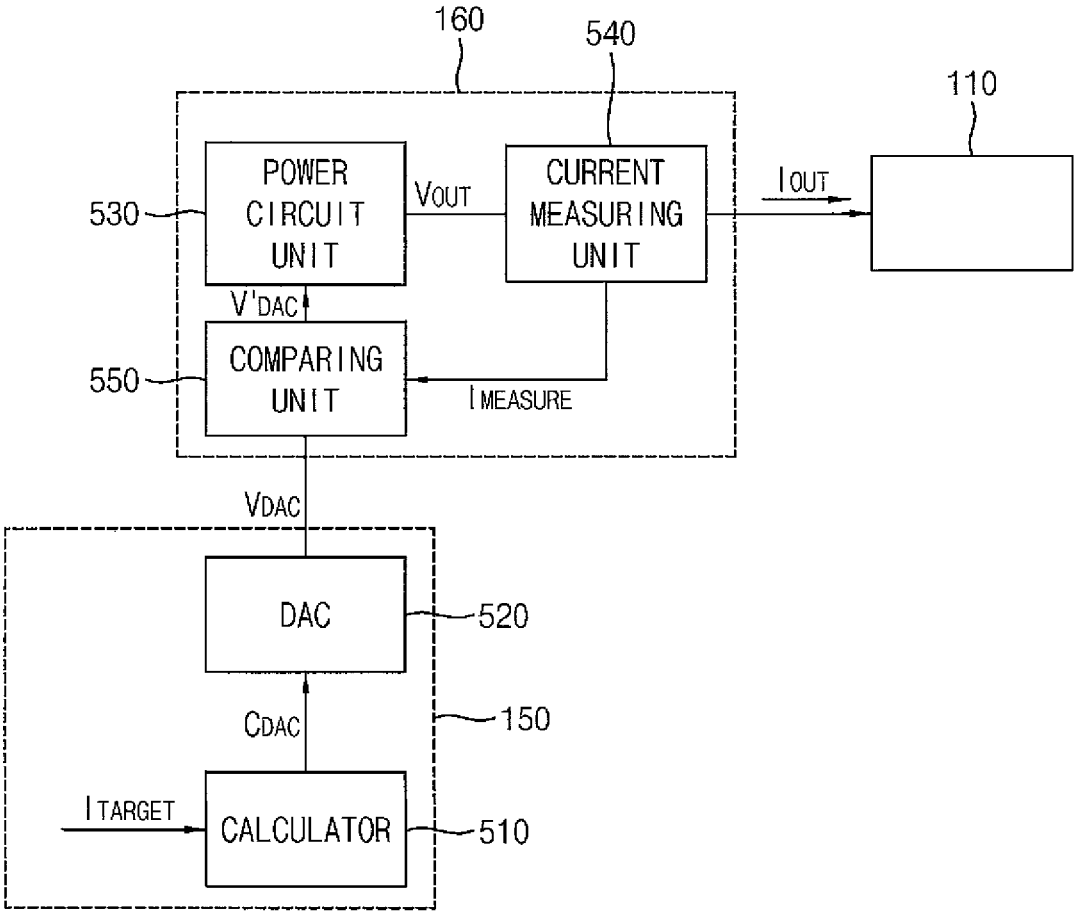
FIG. 5 is a block diagram illustrating an example of a power controller and a power supplier included in the organic light emitting display device of FIG. 1.

FIG. 5 is a block diagram illustrating an example of a power controller and a power supplier included in the organic light emitting display device of FIG. 1.

Referring to FIG. 5, the power controller 150 may include a calculator 510 and a DAC520. The power supplier 160 may include a power circuit unit 530 that controls the first power voltage ELVDD depending on a control signal $V'_{DAC}$ and supplies the first power voltage ELVDD to the display panel 110 through a first power supply line, a current measuring unit 540 that measures the output current $I_{OUT}$ flowing through the first power supply line, and a comparing unit 550 that generates the control signal $V'_{DAC}$ (or, a compensated power voltage control signal) by comparing a power voltage control signal $V_{DAC}$ outputting from the power controller 150 with a measured output current $I_{MEASURE}$. In an exemplary embodiment, the power circuit unit 530 may be a DC-DC converter, for example.

The calculator 510 may generate the target voltage data $C_{DAC}$ based on the target current data $I_{TARGET}$. The calculator 510 may provide the target voltage data $C_{DAC}$ to the DAC520.

In an exemplary embodiment, the calculator 510 may generate the target current data $I_{TARGET}$ by analyzing input image data. In an exemplary embodiment, the calculator 510 may sum grayscales of the input image data and may generate the target current data $I_{TARGET}$ corresponding to a sum of the grayscales, for example.

In an exemplary embodiment, the calculator 510 may convert the target current data $I_{TARGET}$ into the target voltage data $C_{DAC}$ by using a current-voltage (I-V) characteristic of the display panel 110.

In an exemplary embodiment, the calculator 510 may generate the target voltage data $C_{DAC}$ by using a first-order linear equation for the target current data $I_{TARGET}$ and the target voltage data $C_{DAC}$. In an exemplary embodiment, a relationship between the target current data $I_{TARGET}$ and the target voltage data $C_{DAC}$ may be represented by the first-order equation (e.g., the target voltage data $C_{DAC}$=the target current data $I_{TARGET}$*k, where k is an integer), for example. The calculator 510 may generate the target voltage data $C_{DAC}$ by using the first-order linear equation.

As described above, the calculator 510 may generate the target voltage data $C_{DAC}$ that is proportional to the target current data $I_{TARGET}$ without considering the measured current signal $I_{MEASURE}$. Therefore, the calculator 510 may not require a second-order linear equation or a LUT for generating the target voltage data $C_{DAC}$ based on the target current data $I_{TARGET}$ and the measured current signal $I_{MEASURE}$.

The DAC520 may be substantially the same as or similar to the DAC320 that is described with reference to FIG. 3. The DAC520 may convert the target voltage data $C_{DAC}$ into the target voltage signal $V_{DAC}$ that has an analog form.

The power circuit unit 530 may be substantially the same as or similar to the power circuit unit 330 that is described with reference to FIG. 3. The power circuit unit 530 may generate the first power voltage ELVDD based on the compensated power voltage control signal $V'_{DAC}$ (or, a compensated target voltage signal).

The current measuring unit 540 may measure the output current $I_{OUT}$. The current measuring unit 540 may output the measured current signal $I_{MEASURE}$ that has a voltage form. In an exemplary embodiment, the current measuring unit 540 may include a measuring resistor that is electrically connected between the first power supply line and the power circuit unit 530, for example. In the exemplary embodiment, the current measuring unit 540 may output the measured current signal $I_{MEASURE}$ by amplifying a voltage across the measuring resistor.

The comparing unit 550 may generate the compensated power voltage control signal $V'_{DAC}$ by comparing the target voltage signal $V_{DAC}$ with the measured current signal $I_{MEASURE}$.

The comparing unit 550 may calculate the difference voltage signal ΔV by amplifying a difference between the target current signal $I_{MEASURE}$ and the target voltage signal $V_{DAC}$ (i.e., by differentially amplifying the target current signal $I_{MEASURE}$ and the target voltage signal $V_{DAC}$) and may generate the compensated power voltage control signal $V'_{DAC}$ by increasing or decreasing the target voltage signal $V_{DAC}$ by the difference voltage signal ΔV.

As described above, the organic light emitting display device 100 may convert the target current data $I_{TARGET}$ into the target voltage signal $V_{DAC}$ by using the first-order linear equation. The organic light emitting display device 100 may compensate the target voltage signal $V_{DAC}$ based on the measured current signal $I_{MEASURE}$. The organic light emitting display device 100 may adjust the first power voltage ELVDD based on the compensated power voltage control signal $V'_{DAC}$ (or, a compensated target voltage signal). Therefore, the organic light emitting display device 100 may not require a second-order linear equation or a LUT for generating the target voltage data $C_{DAC}$ based on the target current data $I_{TARGET}$ and the measured current signal $I_{MEASURE}$. In an exemplary embodiment, the organic light emitting display device 100 may not require an ADC to convert the measured current signal $I_{MEASURE}$ into a signal that is available in the calculator 510.

The organic light emitting display device 100 may linearly control the first power voltage ELVDD by using only a current feed-back circuit and the first-order linear equation for a correlation between the target current data $I_{TARGET}$ and the target voltage data $C_{DAC}$ (or, a target voltage signal). Therefore, the output current $I_{OUT}$ may be substantially the same as a target current. The organic light emitting display device 100 may quickly compensate a variation of luminance by using a simple circuit construction.

Figure 6:
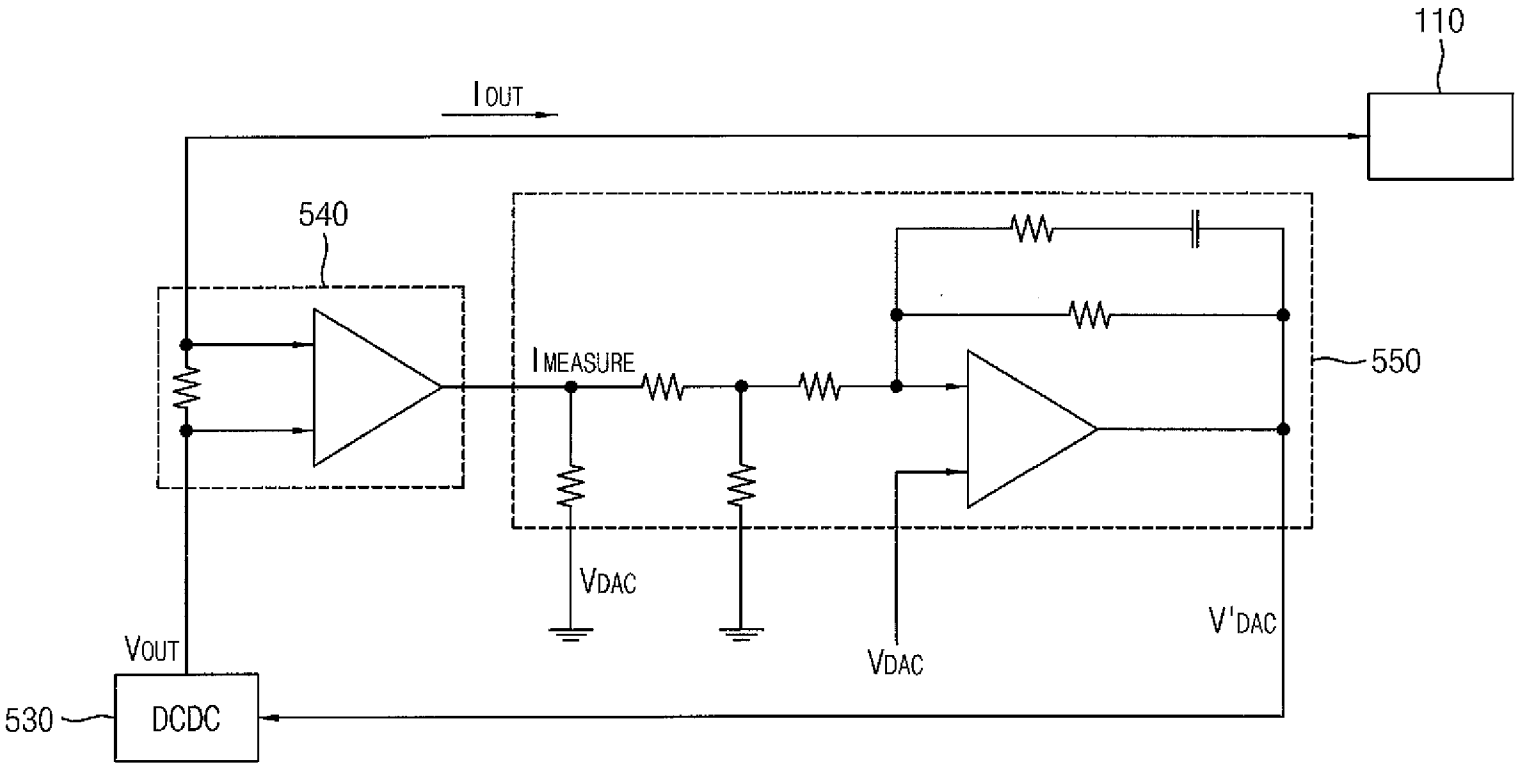
FIG. 6 is a circuit diagram illustrating the power controller and the power supplier of FIG. 5.

FIG. 6 is a circuit diagram illustrating the power controller and the power supplier of FIG. 5.

Referring to FIGS. 5 and 6, the current measuring unit 540 may be arranged on the first power supply line. The current measuring unit 540 may include a measuring resistive element electrically connected in series to the first power supply line, and an amplifier configured to output the measured current signal by differentially amplifying voltages at ends of the measuring resistive element. That is, the current measuring unit 540 may include a measuring resistor (or, resistive element) electrically connected between the display panel 110 and the power circuit unit 530, and a first amplifier that amplifies a voltage across the measuring resistor. In an exemplary embodiment, the measuring resistor may be a resistance component between different points of the first power supply line. The first amplifier may output the measured current signal $I_{MEASURE}$ by amplifying a voltage difference between different points of the first power supply line.

The comparing unit 550 may include a second amplifier, a first resistor array electrically connected between an output terminal of the first amplifier and an input terminal of the second amplifier, and a second resistor array electrically connected between the input terminal of the second amplifier and the power circuit unit 530.

The second amplifier may include a first input terminal, a second input terminal, and an output terminal. The second amplifier may receive the target voltage signal $V_{DAC}$ through the second input terminal and may amplify the measured current signal $I_{MEASURE}$ based on the first resistor array and the second resistor array.

The first resistor array may include a plurality of resistors. The resistors may be electrically connected in series, in parallel, or in a combination of a serial connection and a parallel connection. In an exemplary embodiment, as illustrated in FIG. 6, the first resistor array may include a first resistor electrically connected between an output terminal of the first amplifier and a first input terminal of the second amplifier, second resistor electrically connected in series between the output terminal of the first amplifier and the first input terminal of the second amplifier, and a third resistor electrically connected between a intermediate node (i.e., a node between the second resistors) and a reference voltage, for example.

The second resistor array may include a capacitor electrically connected between the first input terminal of the second amplifier and an output terminal of the second amplifier. In an exemplary embodiment, as illustrated in FIG. 6, the second resistor array may include a fourth resistor, a fifth resistor, and a capacitor, for example. Here, the fourth resistor and the capacitor may be electrically in series between the first input terminal and the output terminal of the second amplifier, and the fifth resistor may be electrically connected in parallel to the fourth resistor and the capacitor. The second resistor array may integrate a difference between the target voltage signal $V_{DAC}$ and the measured current signal $I_{MEASURE}$ with time.

Therefore, the organic light emitting display device 100 may compensate the target voltage signal $V_{DAC}$ based on the measured current signal $I_{MEASURE}$. In an exemplary embodiment, the organic light emitting display device 100 may compensate the target voltage signal $V_{DAC}$ in proportion to a difference between the target voltage signal $V_{DAC}$ and the measured current signal $I_{MEASURE}$, or an integration of the difference for some periods of time, for example.

The power circuit unit 530 may adjust the first power voltage ELVDD based on the compensated target voltage signal $V'_{DAC}$. The power circuit unit 530 may supply the display panel 110 with the output current $I_{OUT}$ corresponding to the target current data $I_{TARGET}$.

Figure 7A:
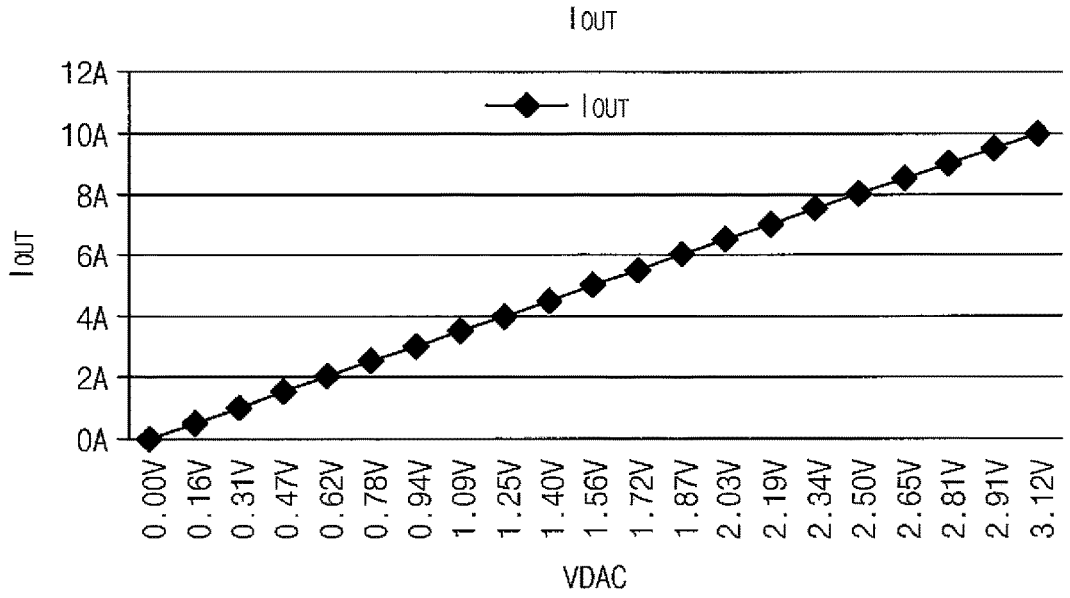
FIGS. 7A and 7B are waveform diagrams for describing an output current generated by the power controller and the power supplier of FIG. 5.
Figure 7B:
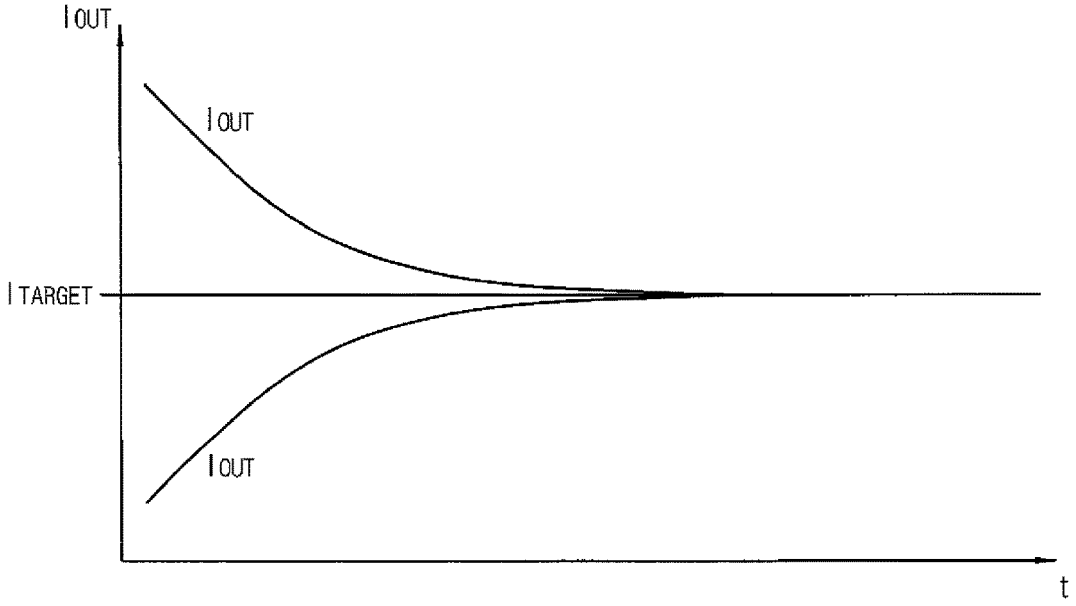

FIGS. 7A and 7B are waveform diagrams for describing an output current generated by the power controller and the power supplier of FIG. 5.

Referring to FIGS. 7A and 7B, FIG. 7A shows a correlation between a target voltage signal $V_{DAC}$ and an output current $I_{OUT}$. In an exemplary embodiment, as the target voltage signal $V_{DAC}$ is increased from about 0 volt (V) to 3.12V, the output current $I_{OUT}$ may be increased from about 0 ampere (A) to about 10 A in proportion to the target voltage signal $V_{DAC}$, for example. The correlation between a target voltage signal $V_{DAC}$ and an output current $I_{OUT}$ may be linear. In addition, FIG. 7B shows a waveform of the output current $I_{OUT}$ with time.

The organic light emitting display device 100 may output the first power voltage ELVDD based on the target current data $I_{TARGET}$. In an exemplary embodiment, the output current $I_{OUT}$ may be greater than the target current data $I_{TARGET}$. Thereby, the organic light emitting display device 100 may compensate the target voltage signal $V_{DAC}$ based on the measured current signal $I_{MEASURE}$ (i.e., a measured output current). Here, the target voltage signal $V_{DAC}$ may correspond to the target current data $I_{TARGET}$. The organic light emitting display device 100 may adjust the first power voltage ELVDD based on the compensated target voltage signal $V'_{DAC}$ (i.e., a power voltage control signal). Therefore, the output current may be linearly reduced with time, and the output current $I_{OUT}$ may have the same level as that of the target current data $I_{TARGET}$.

When the output current $I_{OUT}$ is lower than the target current data $I_{TARGET}$, the organic light emitting display device 100 may compensate the target voltage signal $V_{DAC}$ based on the measured current signal $I_{MEASURE}$. The organic light emitting display device 100 may increase the output current $I_{OUT}$ linearly with time. The organic light emitting display device 100 may output the output current $I_{OUT}$ that has the same level as that of the target current data $I_{TARGET}$.

As described above, the organic light emitting display device 100 may increase or decrease the output current $I_{OUT}$ linearly. Therefore, the organic light emitting display device 100 may prevent a rocking of a screen from occurring during a process of adjusting the first power voltage ELVDD.

Figure 8:
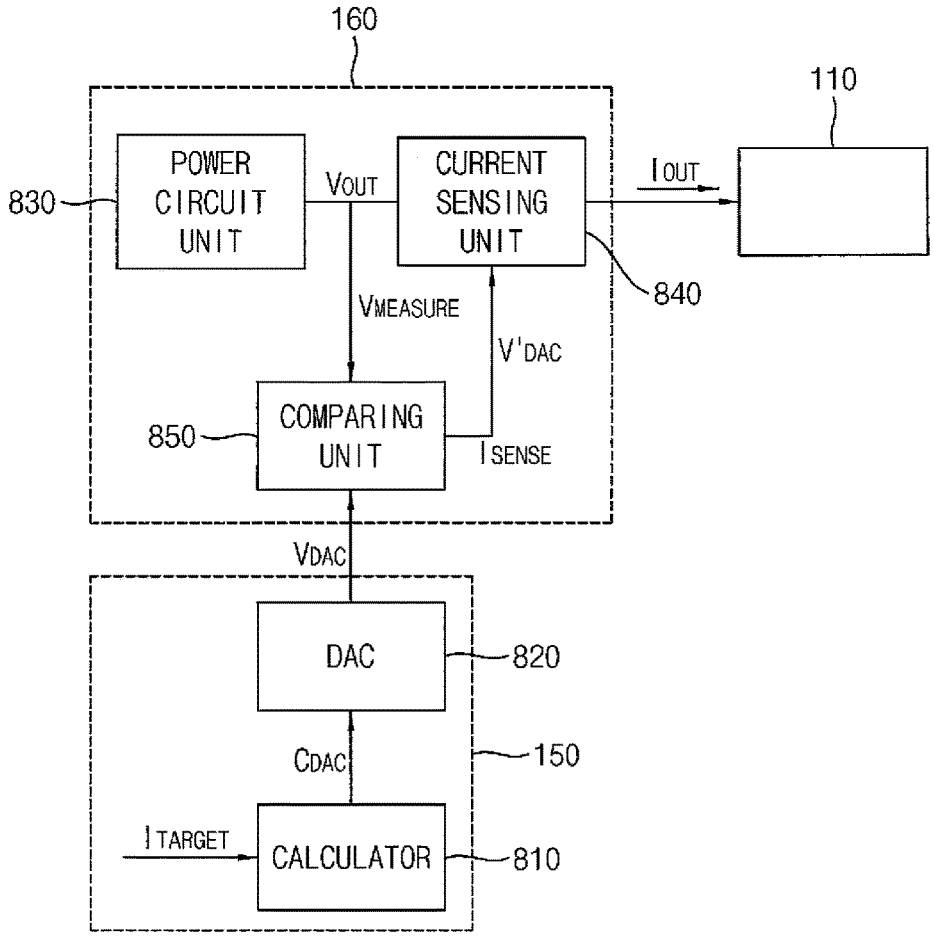
FIG. 8 is a block diagram illustrating an example of a power controller and a power supplier included in the organic light emitting display device of FIG. 1.

FIG. 8 is a block diagram illustrating an example of a power controller and a power supplier included in the organic light emitting display device of FIG. 1.

Referring to FIGS. 1 and 8, the organic light emitting display device 100 may include the power controller 150 that outputs a target voltage signal $V_{DAC}$ of the first power voltage ELVDD by analyzing input image data, and the power supplier 160 that adjusts the output current $I_{OUT}$ flowing through the first power supply line by comparing the target voltage signal and a voltage at one point of the first power supply line.

The power controller 150 may include a calculator 810 and a DAC820. The power controller 150 illustrated in FIG. 8 may be substantially the same as or similar to the power controller 150 illustrated in FIG. 5. Thus, duplicated description will not be repeated.

The power supplier 160 may include a power circuit unit 830 that generates the first power voltage ELVDD, a current control unit 840 that is electrically connected between the first power supply line and the power circuit unit 830 and that controls the output current $I_{OUT}$ based on a control signal $V'_{DAC}$, and a comparing unit 850 that generates the control signal $V'_{DAC}$ by comparing the target voltage signal $V_{DAC}$ and a measured voltage $V_{MEASURE}$ measured at one point of the first power supply line. In an exemplary embodiment, the power circuit unit 830 may be a DC-DC converter, for example.

The power circuit unit 830 may output the first power voltage ELVDD that has a constant level independent of the target voltage signal $V_{DAC}$.

The current control unit 840 may control an amount of the output current $I_{OUT}$ flowing through the first power supply line based on the target voltage signal $V_{DAC}$. In an exemplary embodiment, the current control unit 840 may be a switch that is electrically connected in series to the first power supply line, for example.

The comparing unit 850 may generate the control signal $V'_{DAC}$ by comparing the target voltage signal $V_{DAC}$ and the measured voltage $V_{MEASURE}$. In an exemplary embodiment, the comparing unit 850 may measure a voltage at a front end of a switch (i.e., one end of a switch electrically connected to the power circuit unit 830), for example. The comparing unit 850 may output the control signal $V'_{DAC}$ by differentially amplifying the measured voltage $V_{MEASURE}$ (i.e., a measured voltage) and the target voltage signal $V_{DAC}$ (i.e., by amplifying a difference between the measured voltage $V_{MEASURE}$ and the target voltage signal $V_{DAC}$).

Figure 9:
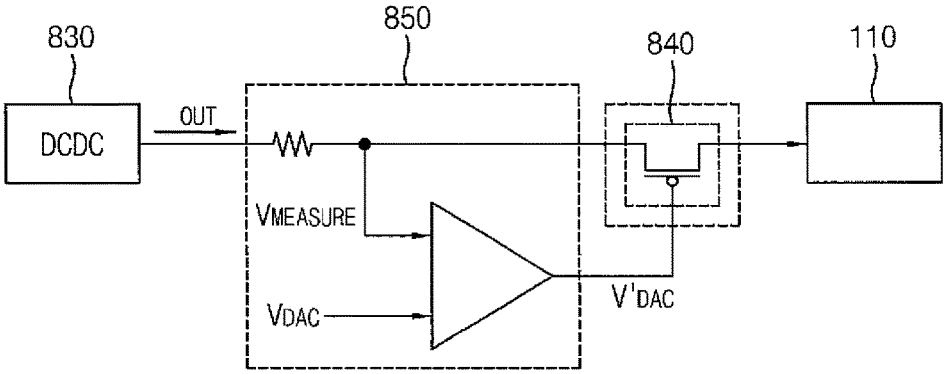
FIG. 9 is a circuit diagram illustrating the power controller and the power supplier of FIG. 8.

FIG. 9 is a circuit diagram illustrating the power controller and the power supplier of FIG. 8.

Referring to FIGS. 8 and 9, the current control unit 840 may include a switch electrically connected between the power circuit unit 830 and the display panel 110. In an exemplary embodiment, the switch may control the output current $I_{OUT}$ that flows through the first power supply line in response to the control signal $V'_{DAC}$, for example.

The comparing unit 850 may include a third amplifier that is electrically connected between one point (e.g., one end of the current control unit 840) and an output terminal of a power controller 150. The third amplifier may amplify a difference between the measured voltage $V_{MEASURE}$ and the target voltage signal $V_{DAC}$. The comparing unit 850 may supply the current control unit 840 with the control signal $V'_{DAC}$ generated by amplifying the difference between the measured voltage $V_{MEASURE}$ and the target voltage signal $V_{DAC}$ (i.e., by differentially amplifying the measured voltage $V_{MEASURE}$ and the target voltage signal $V_{DAC}$).

The organic light emitting display device 100 may not require an ADC to convert the measured current signal $I_{MEASURE}$ into a digital signal and to supply the digital signal to the power controller 150. Also, the organic light emitting display device 100 may not require a converting algorithm or a LUT for converting target current data $I_{TARGET}$ compensated by the measured current signal $I_{MEASURE}$ into the target voltage data $V_{DAC}$.

Figure 10:
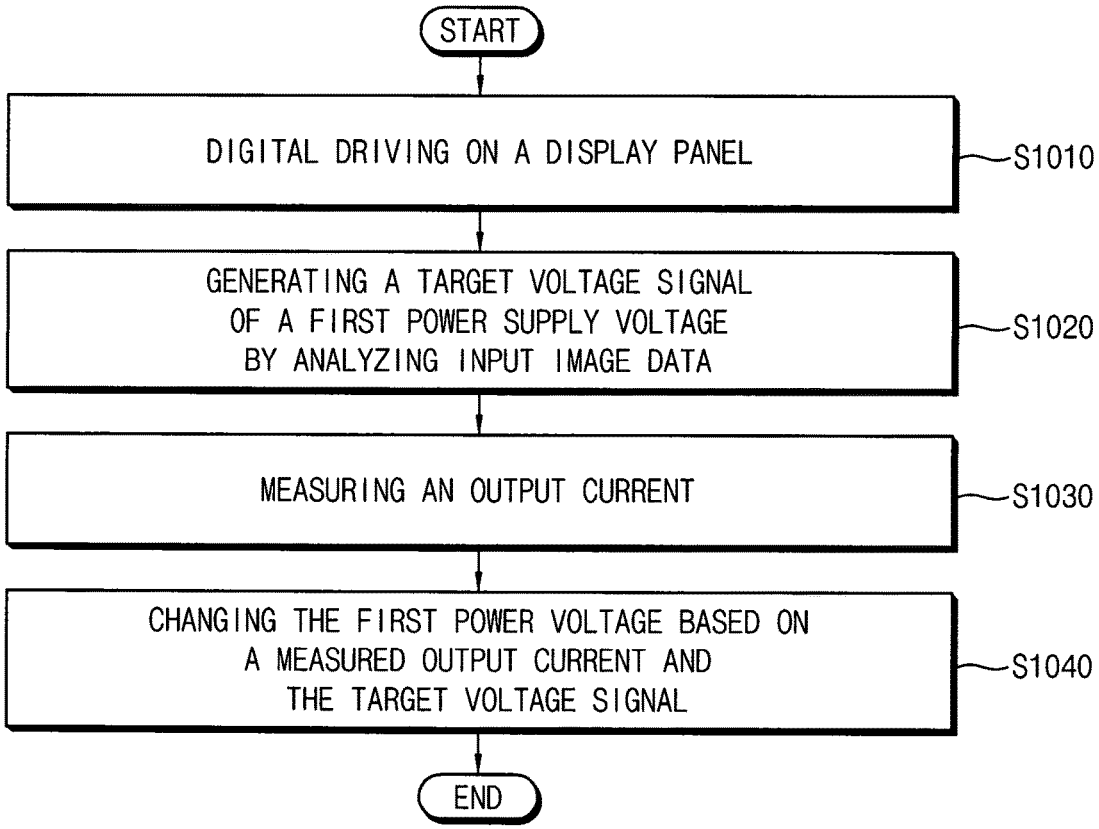
FIG. 10 is a flowchart illustrating exemplary embodiments of a method of driving an organic light emitting display device according to the invention.

FIG. 10 is a flowchart illustrating a method of driving an organic light emitting display device according to exemplary embodiments.

Referring to FIGS. 1 and 10, the method of FIG. 10 may drive the organic light emitting display device 100. By the method of FIG. 10, the organic light emitting display device 100 may perform a digital driving on the display panel 110 supplied with a first power voltage through a first power supply line (S1010). The digital driving technique is one of various techniques for driving the display panel 110. According to the digital driving technique, the pixels 111 may be supplied with a constant data voltage and grayscales may be represented by changing (or, adjusting) a light emission time in which an organic light emitting diode emits light.

The organic light emitting display device 100 may generate the target voltage signal $V_{DAC}$ of the first power voltage ELVSS (S1020) by analyzing input image data supplied to the display panel 110. In an exemplary embodiment, the organic light emitting display device 100 may calculate the target current data $I_{TARGET}$ by analyzing grayscales of the input image data, for example. The organic light emitting display device 100 may generate the target voltage data $C_{DAC}$ by using a linear equation for the target current data $I_{TARGET}$ and the target voltage data $C_{DAC}$. The organic light emitting display device 100 may output the target voltage signal $V_{DAC}$ by converting the target voltage data $C_{DAC}$ into an analog signal.

The organic light emitting display device 100 may measure the output current flowing through the first power supply line (S1030) and may change the first power voltage based on the measured output current $I_{MEASURE}$ and the target voltage signal $V_{DAC}$ (S1040). The organic light emitting display device 100 may compensate the target voltage signal $V_{DAC}$ based on the measured output current $I_{MEASURE}$ and may change the first power voltage ELVDD in response to the compensated target voltage signal $V'_{DAC}$. Therefore, the organic light emitting display device 100 may control the first power voltage ELVDD such that the output current $I_{OUT}$ may follow the target current signal $I_{TARGET}$.

Figure 11:
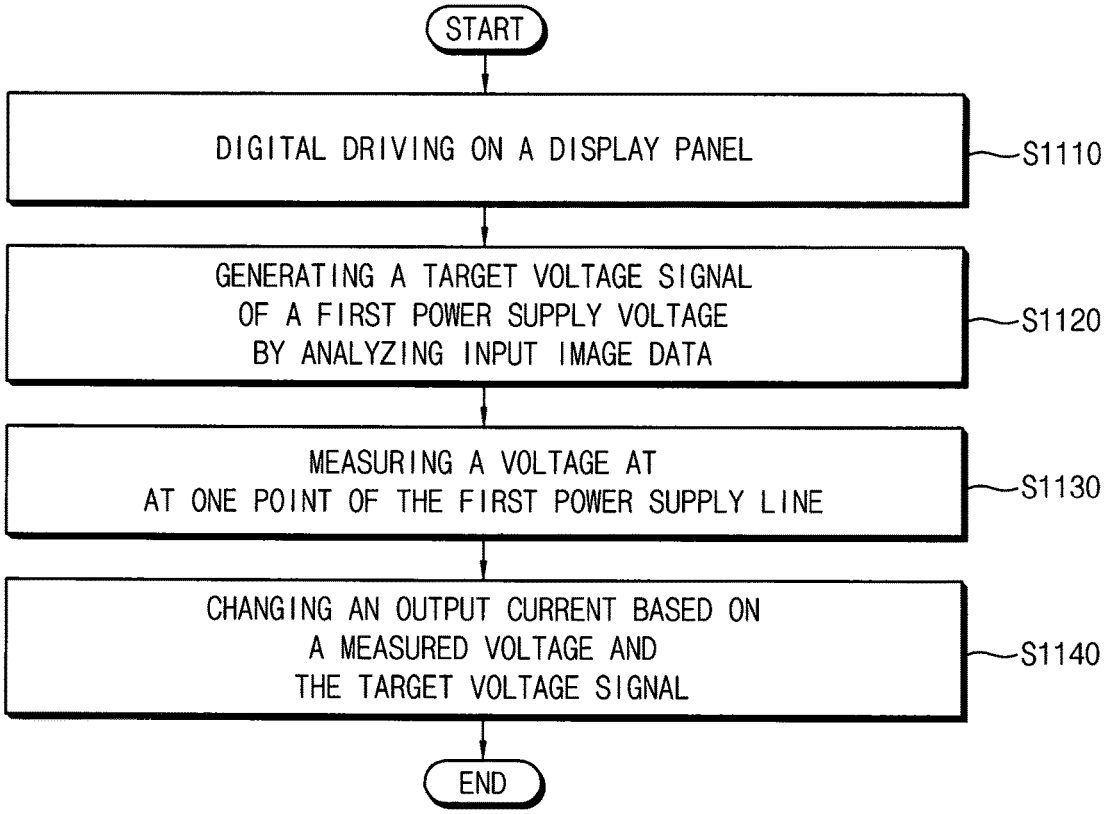
FIG. 11 is a flowchart illustrating exemplary embodiments of a method of driving an organic light emitting display device according to the invention.

FIG. 11 is a flowchart illustrating a method of driving an organic light emitting display device according to exemplary embodiments.

Referring to FIGS. 1 and 11, the method of FIG. 11 may drive the organic light emitting display device 100. By the method of FIG. 11, the organic light emitting display device

100 may perform a digital driving on the display panel 110 supplied with a first power voltage through a first power supply line (S1110).

The organic light emitting display device 100 may generate the target voltage signal $V_{DAC}$ of the first power voltage ELVSS (S1120) by analyzing input image data supplied to the display panel 110.

The organic light emitting display device 100 may measure a voltage at one point of the first power supply line (S1130) and may change the output current $I_{OUT}$ flowing through the first power supply line based on the measured voltage $V_{MEASURE}$ and the target voltage signal $V_{DAC}$ (S1140). As described above, the organic light emitting display device 100 may include a switch that controls an amount of the output current $I_{OUT}$ flowing through the first power supply line. The organic light emitting display device 100 may generate the control signal $V'_{DAC}$ for the switch by amplifying a difference between the target voltage signal $V_{DAC}$ and a measured voltage $V_{MEASURE}$ that is measured at a front end of the switch. Here, the measured voltage $V_{MEASURE}$ may be variable due to a resistive element (i.e., a resistive element between the power circuit unit and the switch) and an amount of the output current $I_{OUT}$ flowing through the first power supply line.

Therefore, the organic light emitting display device 100 may control the output current $I_{OUT}$ flowing through the first power supply line to follow (or, track) the target current data $I_{TARGET}$ by using a simple circuit configuration.

According to exemplary embodiments, the method of FIG. 11 may directly compensate a target voltage signal $V_{DAC}$ based on a measured current (or, a measured voltage) such that an output current $I_{OUT}$ may follow target current data $I_{TARGET}$. Therefore, the method of FIG. 11 may not require an operation of compensating a target current data $I_{TARGET}$ based on a measured current signal $I_{MEASURE}$ (or, a measured voltage signal $V_{MEASURE}$) and an operation of converting the measured current (or, the measured voltage) into a digital. In addition, the method of FIG. 11 may perform a linear control to simply increase or simply decrease the output current $I_{OUT}$. Therefore, the method of FIG. 11 may solve problems such as a rocking of a screen that occurs in a process of controlling the output current $I_{OUT}$.

The invention may be applied to any display device (e.g., an organic light emitting display device, a liquid crystal display device, etc.) including a display panel. In an exemplary embodiment, the invention may be applied to various types of electronic devices such as a television, a computer monitor, a laptop, a digital camera, a cellular phone, a smart phone, a personal digital assistant ("PDA"), a portable multimedia player ("PMP"), an MP3 player, a navigation system, a video phone, etc.

The foregoing is illustrative of exemplary embodiments, and is not to be construed as limiting thereof. Although a few exemplary embodiments have been described, those skilled in the art will readily appreciate that many modifications are possible in the exemplary embodiments without materially departing from the novel teachings and advantages of exemplary embodiments. Accordingly, all such modifications are intended to be included within the scope of exemplary embodiments as defined in the claims. In the claims, means-plus-function clauses are intended to cover the structures described herein as performing the recited function and not only structural equivalents but also equivalent structures. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of driving an organic light emitting display device, the method comprising:

performing a digital driving on a display panel supplied with a first power voltage through a first power supply line;

generating target voltage data based on a sum of the grayscales of the input image data;

converting the target voltage data into a target voltage in an analog form using a digital-analog converter;

generating a measured voltage corresponding to an output current which flows through the first power supply line by including a measuring resistive element electrically connected in series to the first power supply line;

wherein a first amplifier outputs the measured voltage by differentially amplifying voltages at ends of the measuring resistive element;

wherein a second amplifier receives the target voltage and the measured voltage to generate a control signal based on a difference between the target voltage and the measured voltage; and changing the first power voltage based on the control signal.

2. The method of claim 1, wherein the target voltage data is calculated using a current-voltage characteristic of the display panel.

3. The method of claim 1, wherein the target voltage data is generated using a first-order linear equation between a target current data based on the sum of the grayscales of the input image data and the target voltage data.

4. The method of claim 1, wherein the generating the control signal includes:

generating a difference voltage signal at the output of the second amplifier by differentially amplifying the difference between the measured voltage and the target voltage; and increasing or decreasing the target voltage by the difference voltage signal to generate the control signal.

5. A method of driving an organic light emitting display device, the method comprising:

performing a digital driving on a display panel supplied with a first power voltage through a first power supply line;

generating target voltage data based on a sum of the grayscales of the input image data;

converting the target voltage data into a target voltage in an analog form using a digital-analog converter;

measuring a voltage difference between different points of the first power supply line by including a measuring resistor;

wherein a first amplifier outputs a measured voltage by differentially amplifying the voltage difference across the measuring resistor;

wherein a second amplifier receives the target voltage and the measured voltage to generate a control signal based on a difference between the target voltage and the measured voltage;

compensating the target voltage based on the control signal to produce a compensated target voltage; and changing an output current flowing through the first power supply line based on the compensated target voltage.

6. The method of claim 5, wherein the target voltage data is calculated using a current-voltage characteristic of the display panel.

7. The method of claim 5, wherein the target voltage data is generated using a first-order linear equation between a target current data based on the sum of the grayscales of the input image data and the target voltage data.

8. The method of claim 5, wherein the compensating the target voltage includes amplifying the measured voltage and the target voltage differentially.

9. The method of claim 5, wherein the changing the output current includes supplying the compensated target voltage to a switching component which is electrically connected in series to the first power supply line.

10. An organic light emitting display device comprising:

a timing controller which generates input image data;

a display panel which receives a first power voltage through a first power supply line and operates based on a digital driving technique;

a power controller which generates target voltage data based on a sum of the grayscales of the input image data and converts the target voltage data into a target voltage in an analog form using a digital-analog converter; and a power supplier which measures an output current which flows through the first power supply line and changes the first power voltage based on a measured output current and the target voltage, wherein the power supplier includes:

a current measuring unit which generates a measured voltage corresponding to the output current which flows through the first power supply line by including a measuring resistive element electrically connected in series to the first power supply line;

a first amplifier that outputs the measured voltage by differentially amplifying voltages at ends of the measuring resistive element; and a second amplifier that receives the target voltage and the measured voltage to generate a control signal based on a difference between the target voltage and the measured voltage and generates the first power voltage based on the control signal.

11. The organic light emitting display device of claim 10, wherein the second amplifier generates a difference voltage signal by differentially amplifying the measured voltage and the target voltage and increases or decreases the target voltage by the difference voltage signal to generate the control signal.

* * * * *